US006375550B1

(12) United States Patent
Berman

(10) Patent No.: US 6,375,550 B1
(45) Date of Patent: Apr. 23, 2002

(54) METHOD AND APPARATUS FOR ENHANCING UNIFORMITY DURING POLISHING OF A SEMICONDUCTOR WAFER

(75) Inventor: Michael J. Berman, West Linn, OR (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/587,609

(22) Filed: Jun. 5, 2000

(51) Int. Cl.[7] ..... B24B 1/00
(52) U.S. Cl. ..... 451/41; 451/288
(58) Field of Search ..... 451/5, 41, 42, 451/57, 63, 65, 285, 287, 288, 289, 397, 398

(56) References Cited

U.S. PATENT DOCUMENTS

| | | | | | |
|---|---|---|---|---|---|
| 5,245,790 | A | | 9/1993 | Jerbic | |
| 5,265,378 | A | | 11/1993 | Rostoker | |
| 5,310,455 | A | | 5/1994 | Pasch et al. | |
| 5,321,304 | A | | 6/1994 | Rostoker | |
| 5,389,194 | A | | 2/1995 | Rostoker et al. | |
| 5,403,228 | A | | 4/1995 | Pasch | |
| 5,516,400 | A | | 5/1996 | Pasch et al. | |
| 5,605,488 | A | * | 2/1997 | Ohashi et al. | 451/288 |
| 5,624,304 | A | | 4/1997 | Pasch et al. | |
| 5,626,715 | A | | 5/1997 | Rostoker | |
| 5,667,433 | A | | 9/1997 | Mallon | |
| 5,733,182 | A | * | 3/1998 | Muramatsu et al. | 451/288 |
| 5,762,539 | A | * | 6/1998 | Nakashiba et al. | 451/288 |
| 5,861,055 | A | | 1/1999 | Allman et al. | |
| 5,865,666 | A | | 2/1999 | Nagahara | |
| 5,868,608 | A | | 2/1999 | Allman et al. | |
| 5,882,251 | A | | 3/1999 | Berman et al. | |
| 5,888,120 | A | | 3/1999 | Doran | |
| 5,893,756 | A | | 4/1999 | Berman et al. | |
| 5,931,719 | A | | 8/1999 | Nagahara et al. | |
| 5,948,697 | A | | 9/1999 | Hata | |
| 5,957,757 | A | | 9/1999 | Berman | |
| 6,050,882 | A | * | 4/2000 | Chen | 451/288 |
| 6,093,089 | A | * | 7/2000 | Chen et al. | 451/288 |
| 6,135,858 | A | * | 10/2000 | Takahashi | 451/288 |

* cited by examiner

*Primary Examiner*—Derris H. Banks
(74) *Attorney, Agent, or Firm*—Maginot, Addison & Moore

(57) ABSTRACT

A chemical-mechanical polishing apparatus for polishing a first side of a semiconductor wafer includes a polishing platen having a polishing surface. The apparatus also includes a wafer carrier assembly having a carrier body. The wafer carrier assembly is adapted to (i) engage the wafer by a second side of the wafer, and (ii) apply pressure to the wafer in order to press the wafer against the polishing surface of the polishing platen. The wafer carrier assembly is operable in a first carrier configuration and a second carrier configuration. A first fixture which is configured to apply pressure to the wafer at a first number of predetermined locations is secured to the carrier body when the wafer carrier assembly is operated in the first carrier configuration. A second fixture which is configured to apply pressure to the wafer at a second number of predetermined locations which are different than the first number of predetermined locations is secured to the carrier body when the wafer carrier assembly is operated in the second carrier configuration. A method of operating a chemical-mechanical polishing system is also disclosed.

19 Claims, 4 Drawing Sheets

METHOD AND APPARATUS FOR ENHANCING UNIFORMITY DURING POLISHING OF A SEMICONDUCTOR WAFER

TECHNICAL FIELD OF THE INVENTION

The present invention relates generally to a method of fabricating a semiconductor wafer, and more particularly to a method and apparatus for enhancing uniformity during polishing of a semiconductor wafer.

BACKGROUND OF THE INVENTION

Semiconductor integrated circuits are typically fabricated by a layering process in which several layers of material are fabricated on a surface of a wafer. This fabrication process typically requires subsequent layers to be fabricated upon a smooth, planar surface of a previous layer. However, the surface topography of layers may be uneven due to an uneven topography associated with an underlying layer. As a result, a layer may need to be polished in order to present a smooth, planar surface to a subsequent processing step. For example, an insulator layer may need to be polished prior to formation of a conductor layer or pattern on an outer surface thereof.

In general, a semiconductor wafer may be polished to remove high topography and surface defects such as scratches, roughness, or embedded particles of dirt or dust. The polishing process typically is accomplished with a polishing system that includes a wafer carrier or holder and a platen such as a polishing table or moving polishing belt, between which the semiconductor wafer is positioned. The wafer carrier and the platen are moved relative to each other thereby causing material to be removed from the surface of the wafer. This polishing process is often referred to as mechanical planarization (MP) and is utilized to improve the quality and reliability of semiconductor devices.

The polishing process may also involve the introduction of a chemical slurry to facilitate higher removal rates, along with the selective removal of materials fabricated on the semiconductor wafer. This polishing process is often referred to as chemical-mechanical planarization or chemical-mechanical polishing (CMP). The chemical slurry is generally an aqueous acidic or basic solution having a number of abrasive particles, such as silica ($SiO_2$), alumina ($Al_2O_3$), or ceria ($Ce_2O_3$) particles, suspended therein.

Polishing pressure, that is the pressure applied on a wafer by the wafer carrier or a polishing pad secured to the polishing platen, is generally maintained at a constant (e.g. uniform) level across the entire surface area of the wafer. Such a uniform polishing pressure is maintained in an effort to ensure that the same amount of wafer material is removed from all of the sections of the surface of the wafer. Generally speaking, the amount of material removed from the surface of the wafer is proportional to the product of the polishing pressure and the relative velocity of the wafer. It should be appreciated that the relative velocity of the wafer is generally a function of the rotation of the wafer by the wafer carrier.

Heretofore polishing systems have utilized a number of techniques to maintain a uniform polishing pressure. For example, an air bladder has been utilized below the polishing pad of the polishing platen. Inflation of the air bladder serves to apply a uniform pressure to the back of the polishing pad and hence the wafer being polished thereon. Moreover, polishing systems have heretofore been designed to include a number of independently controlled air bladders which can be independently inflated and deflated in order to selectively increase or decrease pressure exerted on the polishing pad.

However, such heretofore designed polishing systems have a number of drawbacks associated therewith. For example, it is known that during manufacture of certain wafer designs, non-uniformity is created in areas of the wafer which are different than the areas of the wafer in which non-uniformity is created in other wafer designs. In other words, it is desirable to adjust the polishing pressure in different locations for certain wafer designs relative to the locations in which polishing pressure is adjusted for other wafer designs. However, existing polishing system designs do not allow for such flexibility. In particular, the location of the air bladders in heretofore designed polishing systems is fixed. Hence, if a certain wafer design requires an increase or decrease in polishing pressure at a location of the wafer which does not correspond to the location of the air bladders of the polishing platen, a separate, dedicated polishing platen must be procured. This is a relatively expensive notion and often requires significant amounts of labor to swap out the polishing platens.

What is needed therefore is a method and apparatus for polishing a semiconductor wafer which overcomes the above-mentioned drawbacks. What is also need is a method and apparatus for polishing which provides for selective increases and decreases in polishing pressure without requiring the use of multiple polishing platens.

SUMMARY OF THE INVENTION

In accordance with one embodiment of the present invention, there is provided a method of operating a chemical-mechanical polishing system which has a wafer carrier assembly which includes a carrier body. The method includes the step of securing a first fixture to the carrier body. The first fixture is configured to apply pressure to a first semiconductor wafer at a first number of predetermined locations. The method also includes the step of polishing the first semiconductor wafer while the first fixture is secured to carrier body. The method further includes the step of removing the first fixture from the carrier body. Yet further, the method includes the step of securing a second fixture to the carrier body. The second fixture is configured to apply pressure to a second semiconductor wafer at a second number of predetermined locations which are different than the first number of predetermined locations of the first wafer. Moreover, the method includes the step of polishing the second semiconductor wafer while the second fixture is secured to the carrier body.

Pursuant to another embodiment of the present invention, there is provided a chemical-mechanical polishing apparatus for polishing a first side of a semiconductor wafer. The apparatus includes a polishing platen having a polishing surface. The apparatus also includes a wafer carrier assembly having a carrier body. The wafer carrier assembly is adapted to (i) engage the wafer by a second side of the wafer, and (ii) apply pressure to the wafer in order to press the wafer against the polishing surface of the polishing platen. The wafer carrier assembly is operable in a first carrier configuration and a second carrier configuration. A first fixture which is configured to apply pressure to the wafer at a first number of predetermined locations is secured to the carrier body when the wafer carrier assembly is operated in the first carrier configuration. A second fixture which is configured to apply pressure to the wafer at a second number of predetermined locations which are different than the first number of predetermined locations is secured to the carrier body when the wafer carrier assembly is operated in the second carrier configuration.

Pursuant to yet another embodiment of the present invention, there is provided a method of operating a chemical-mechanical polishing system which has a polishing surface associated therewith. The method includes the step of securing a first fixture to a fixture receptacle which is located proximate to the polishing surface. The first fixture is configured to apply pressure to the polishing surface at a first number of predetermined locations. The method also includes the step of polishing a first semiconductor wafer while the first fixture is secured to the fixture receptacle. Moreover, the method includes the step of removing the first fixture from the fixture receptacle. In addition, the method includes the step of securing a second fixture to the fixture receptacle. The second fixture is configured to apply pressure to the polishing surface at a second number of predetermined locations which are different than the first number of predetermined locations. In addition, the method includes the step of polishing a second semiconductor wafer while the second fixture is secured to the fixture receptacle.

It is an object of the present invention to provide a new and useful method and apparatus for polishing a semiconductor wafer.

It is also an object of the present invention to provide an improved method and apparatus for polishing a semiconductor wafer.

The above and other objects, features, and advantages of the present invention will become apparent from the following description and the attached drawings.

DETAILED DESCRIPTION OF THE PRESENT INVENTION

Figure 1:
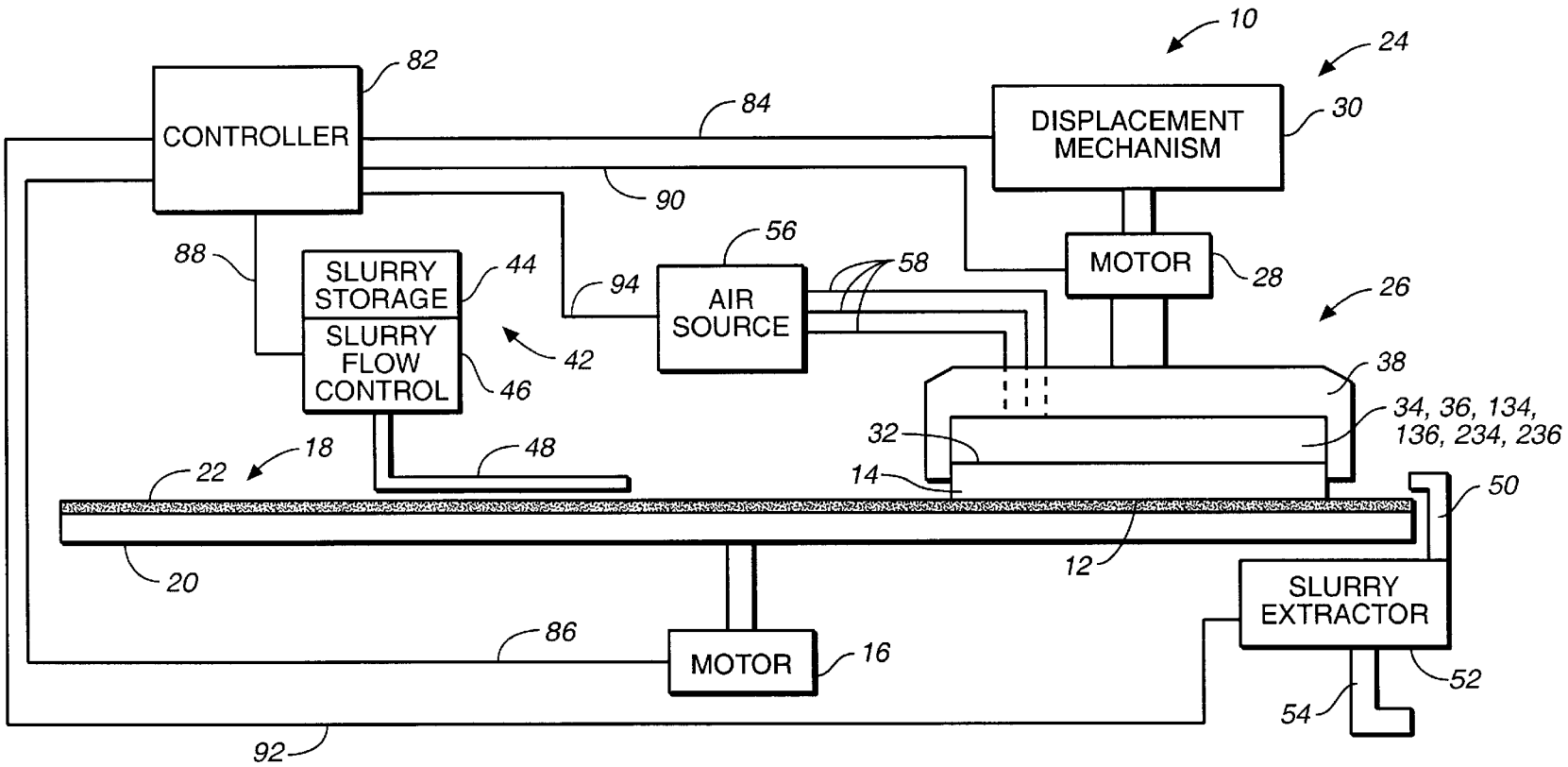
FIG. 1 is a side elevational view of one embodiment of a polishing system which incorporates the various features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Referring now to FIG. 1, there is shown a first embodiment of a polishing system 10 which is used to planarize a front side or surface 12 of a semiconductor wafer 14. The polishing system 10 includes a platen motor or other drive mechanism 16 and a platen assembly 18. The platen motor 16 rotates the platen assembly 18 about a center axis thereof. The platen motor 16 may rotate the platen assembly 18 in a clockwise direction or in a counterclockwise direction.

The platen assembly 18 includes a polishing platen 20 and a polishing pad 22 mounted on the polishing platen 20. Both the polishing platen 20 and the polishing pad 22 are generally circular in shape and collectively define a polishing area or surface against which the front side 12 of the semiconductor wafer 14 may be polished. Alternatively, the platen 20 and the polishing pad 22 may be embodied as an endless belt which is advanced around a pair of rollers. In either event, the polishing pad 22 is typically made of cast polyurethane which protects the polishing platen 20 from chemical slurry and other chemicals introduced during the polishing process.

The polishing system 10 also includes a polishing head assembly 24. The polishing head assembly 24 includes a wafer carrier assembly 26, a wafer carrier motor or other drive mechanism 28, and a wafer carrier displacement mechanism 30. The wafer carrier assembly 26 applies a controlled, adjustable downward force in order to press the front side 12 of the semiconductor wafer 14 into contact with the polishing pad 22 so as to facilitate polishing of the front side 12 of the semiconductor wafer 14.

The wafer carrier motor 28 rotates the wafer carrier assembly 26 and the semiconductor wafer 14 about a center axis thereof. The wafer carrier motor 28 may rotate the wafer carrier assembly 26 in a clockwise direction or in a counterclockwise direction. However, the wafer carrier motor 28 preferably rotates the wafer carrier assembly 26 in the same rotational direction as the platen motor 16 rotates the platen assembly 18 (although it should be appreciated that the wafer carrier motor 28 may rotate the semiconductor wafer 14 in the rotational direction opposite the rotational direction of the platen assembly 18 as desired).

The wafer carrier assembly 26 also includes mechanisms (not shown) for holding the semiconductor wafer 14. For example, the wafer carrier assembly 26 may include a vacuum-type mechanism which generates a vacuum force that draws the semiconductor wafer 14 against the wafer carrier assembly 26. Once the semiconductor wafer 14 is positioned on the wafer carrier assembly 26 and held in contact with the platen assembly 18 for polishing, the vacuum force may be removed.

Figure 2:
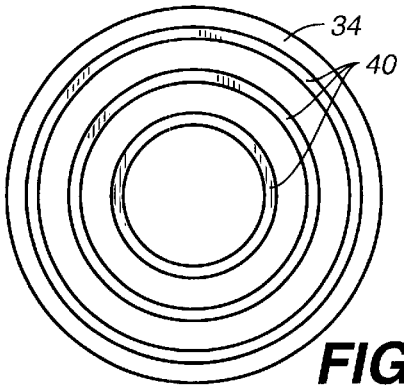
FIGS. 2–7 are plan views of fixtures which may be secured to the wafer carrier assembly of the polishing system of FIG. 1.
Figure 3:
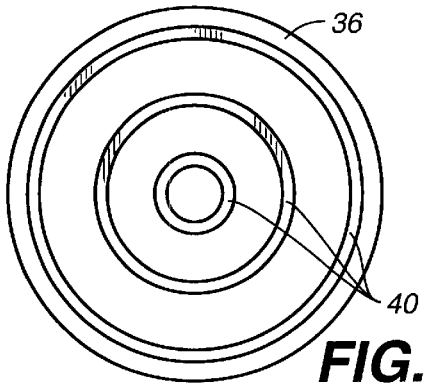

The polishing head assembly 24 also includes a number of fixtures 34, 36 which may be selectively secured to the a body 38 of the wafer carrier assembly 26. Although any number of fixtures may be designed for use with the polishing system 10 of the present invention, for the sake of brevity, the following discussion will exemplary describe the use of two fixtures (i.e. the fixtures 34, 36). The fixtures 34, 36 may be selectively utilized in order to alter the polishing pressure exerted on predetermined locations of the backside 32 of the semiconductor wafer 14. In particular, each of the fixtures 34, 36 includes a number of air bladders 40 which are arranged in unique patterns on the fixture (see FIGS. 2 and 3). The air bladders 40 may be selectively inflated or deflated in order to increase or decrease, respectively, the downward polishing pressure being exerted on predetermined locations on the backside 32 of the semiconductor wafer 14.

In such a manner, the locations at which pressure is increased or decreased on the backside 32 of the semiconductor wafer 14 may be specifically tailored to a given wafer design. In particular, it is known that fabrication of certain wafer designs creates surface non-uniformities which are unique to the given wafer design. Hence, a fixture (e.g. one of the fixtures 34, 36) may be designed which has its various air bladders 40 located in predetermined positions such that when the air bladders 40 are inflated or deflated, downward polishing pressure is increased or decreased, respectively, at the corresponding locations of the wafer 14. Hence, a first fixture which is adapted to apply polishing pressure to predetermined locations of a wafer of a first design type (e.g. the fixture 34) may be secured to the carrier body 38 of the wafer carrier assembly 26 in order to polish wafers of the first design type. Thereafter, prior to polishing of semiconductor wafers of a second design type, the first fixture 34 is removed, and a second fixture which is adapted to apply polishing pressure to predetermined locations of a wafer of a second design type (e.g. the fixture 36) is secured to the carrier body 38 of the wafer carrier assembly 26 in order to polish wafers of the second design type.

It should be appreciated that the fixtures 34, 36 may be secured to the carrier body 38 in a number of different manners. For example, fasteners such as bolts (not shown) may be utilized to secure the fixtures 34, 36 to the carrier body 38. Moreover, "quick coupling" mechanisms may be utilized which allow the fixtures 34, 36 to be secured to, or removed from, the carrier body 38 without the use of tools. In addition, it should be appreciated that the fixtures 34, 36 and the carrier body 38 may each be configured with corresponding keying features in order to ensure proper installation alignment of the fixtures 34, 36 to the carrier body 38.

In order to provide for inflation of the air bladders 40 of the fixtures 34, 36, the polishing system 10 includes a pressurized air source 56. The pressurized air source 56 is fluidly coupled to the air bladders 40 via a number of air lines 58. Each of the air lines 58 has a coupler (not shown) on an end thereof which mates with a corresponding coupler (not shown) on the fixtures 34, 36. In such a manner, the couplers can be quickly and easily coupled to one another when one of the fixtures 34, 36 is being secured to the carrier body 38, but yet can also be quickly decoupled from one another when the fixtures 34, 36 are being removed from the wafer body 38.

It should be appreciated that each of the air lines 58 is under independent control. In particular, air pressure within each of the air lines 58 may be independently controlled in order to allow for selective inflation and deflation of the air bladders 40 of the fixtures 34, 36. Such independent control increases the flexibility of the polishing system 10 by allowing the locations in which pressure is exerted on the wafer 14 to be more precisely defined.

The displacement mechanism 30 of the polishing head assembly 24 selectively moves the wafer carrier assembly 26 and hence the semiconductor wafer 14 across the platen assembly 18 in predetermined directions. Such movement defines a polishing path which may be linear, sinusoidal, or a variety of other patterns. The displacement mechanism 30 is also capable of moving the semiconductor wafer 14 along a polishing path to a location beyond the edge of the polishing pad 22 so that the semiconductor wafer 14 "overhangs" the edge. Such an overhanging arrangement permits the semiconductor wafer 14 to be moved partially on and partially off the polishing pad 22 to compensate for polishing irregularities caused by a relative velocity differential between the faster moving outer portions and the slower moving inner portions of the platen assembly 18.

The polishing system 10 also includes a chemical slurry system 42. The slurry system 42 includes a slurry storage reservoir 44, a slurry flow control mechanism 46, and a slurry conduit 48. The slurry storage reservoir 44 includes one or more containers for storing chemical slurry. In particular, the slurry storage reservoir 44 contains a chemical slurry such as an aqueous acidic or basic solution having a number of abrasive particles, such as silica ($SiO_2$), alumina ($Al_2O_3$), or ceria ($Ce_2O_3$) particles, suspended therein. The slurry flow control mechanism 46 controls the flow of slurry from the slurry storage 44, through the slurry conduit 48, and onto the polishing area atop the platen assembly 18. Hence, the slurry flow control mechanism 46 selectively introduces a flow of chemical slurry onto the polishing pad 22 via the slurry conduit 48.

The polishing system 10 also includes extraction conduit 50, an extraction flow control mechanism 52, and a waste conduit 54. The extraction conduit 50 receives effluent from the polishing area associated with the platen assembly 18. The effluent includes the chemical slurry from the slurry supply system 42 along with materials removed from the semiconductor wafer 14. The extraction flow control mechanism 52 controls the flow of effluent from the extraction conduit 50 to the waste conduit 54. The waste conduit 54 of the polishing system 10 is fluidly coupled to a waste treatment facility (not shown) in order to chemically treat or otherwise properly dispose of the effluent subsequent to extraction thereof.

The polishing system 10 also includes a controller 82 for controlling the polishing system 10 in order to effectuate the desired polishing results for the semiconductor wafer 14. In particular, the controller 82 is electrically coupled to the displacement mechanism 30 via a signal line 84 to monitor and controllably adjust the polishing path of the semiconductor wafer 14 and the speed at which the semiconductor wafer 14 is moved across the platen assembly 18.

Moreover, the controller 82 is electrically coupled to the platen motor 16 via a signal line 86 in order to monitor the output speed of the platen motor 16 and hence the rotational velocity of the platen assembly 18. The controller 82 adjusts the output speed of the platen motor 16 and hence the rotational velocity of the platen assembly 18 as required by predetermined operating parameters.

The controller 82 is electrically coupled to the slurry flow control mechanism 46 via a signal line 88 in order to monitor the flow rate of the chemical polishing slurry onto the polishing pad 22 of the platen assembly 18. The controller 82 adjusts the flow rate of the chemical slurry onto the polishing pad 22 of the platen assembly 18 as required by predetermined operating parameters.

The controller 82 is electrically coupled to the wafer carrier motor 28 via a signal line 90 in order to monitor the output speed of the wafer carrier motor 28 and hence the rotational velocity of the wafer carrier assembly 26. The controller 82 adjusts the output speed of the wafer carrier motor 28 and hence the rotational velocity of the wafer carrier assembly 26 as required by predetermined operating parameters.

The controller 82 is electrically coupled to the extraction flow control mechanism 52 via a signal line 92 in order to monitor the flow rate of the effluent from the polishing area of the platen assembly 18 to the waste conduit 54. The controller 82 adjusts the flow rate of the effluent from the polishing area of the platen assembly 18 as required by predetermined operating parameters.

The controller 82 is also electrically coupled to the pressurized air source 56 via a signal line 94 in order to selectively increase or decrease air pressure within each of the air lines 58. In particular, as described above, air pressure within each of the air lines 58 is independently controllable so as to allow for selective inflation or deflation of the individual air bladders 40.

Figure 4:
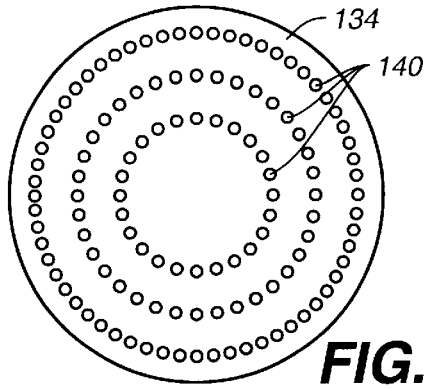
Figure 5:
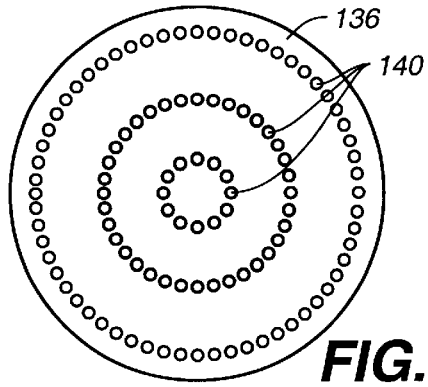

Referring now to FIGS. 4 and 5, there are shown alternative embodiments of the fixtures 34, 36 (hereinafter designated with reference numerals 134, 136, respectively). In lieu of the air bladders 40, the fixtures 134, 136 include a number of air orifices 140 which are positioned in predetermined locations and patterns on the fixtures. Pressurized air is selectively directed out of the air orifices 140 in order to increase the downward polishing pressure being exerted at predetermined locations on the backside 32 of the semiconductor wafer 14. In such a manner, the locations at which pressure is increased on the backside 32 of the semiconductor wafer 14 may be specifically tailored to a given wafer design thereby allowing the polishing system 10 to remove non-uniformities which are unique to the given wafer design. Hence, a fixture (e.g. one of the fixtures 134, 136) may be designed which has its various air orifices 140 located in predetermined positions such that when pressurized air is advanced therethrough, downward polishing pressure in increased at the corresponding locations of the wafer 14. Hence, a first fixture which is adapted to apply polishing pressure to predetermined locations of a wafer of a first design type (e.g. the fixture 134) may be secured to the carrier body 38 of the wafer carrier assembly 26 in order to polish wafers of the first design type. Thereafter, prior to polishing of semiconductor wafers of a second design type, the first fixture 134 is removed, and a second fixture which has air orifices 140 which are adapted to apply polishing pressure to different predetermined locations of a wafer (e.g. the fixture 136) is secured to the carrier body 38 of the wafer carrier assembly 26 in order to polish wafers of the second design type.

As with the fixtures 34, 36, it should be appreciated that the fixtures 134, 136 may be secured to the carrier body 38 in a number of different manners. For example, fasteners such as bolts (not shown) may be utilized to secure the fixtures 134, 136 to the carrier body 38, or alternatively, "quick coupling" mechanisms may be utilized which allow the fixtures 134, 136 to be secured to or removed from the carrier body 38 without the use of tools. In addition, it should be appreciated that the fixtures 134, 136 and the carrier body 38 may each be configured with corresponding keying features in order to ensure proper installation alignment of the fixtures 134, 136 to the carrier body 38.

The pressurized air source 56 is fluidly coupled to the air orifices 140 via the air lines 58 in order to provide the pressurized air necessary for direction through the air orifices 140. Similarly to as described above in regard to the fixtures 34, 36, the couplers associated with the air lines 58 and the fixtures 134, 136 (not shown) can be quickly and easily coupled to one another when one of the fixtures 134, 136 is being secured to the carrier body 38, but yet can also be quickly decoupled from one another when the fixtures 134, 136 are being removed from the wafer body 38.

Since each of the air lines 58 is under independent control, air pressure within each of the air lines 58 may be independently altered in order to allow for selective increases in pressurized air being directed out of the air orifices 140. As with the fixtures 34, 36, such independent control of pressurized air being advanced out of the air orifices 140 increases the flexibility of the polishing system 10 by allowing the locations in which pressure is exerted on the wafer 14 to be more precisely defined.

Figure 6:
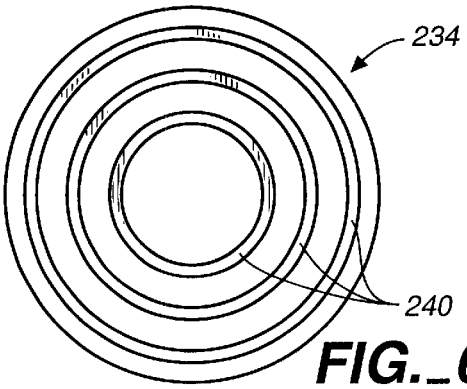
Figure 8:
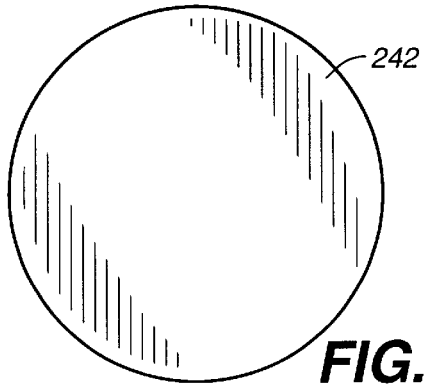
FIG. 8 is a plan view of a carrier wafer film which is utilized in conjunction with the polishing system of FIG. 1.
Figure 7:
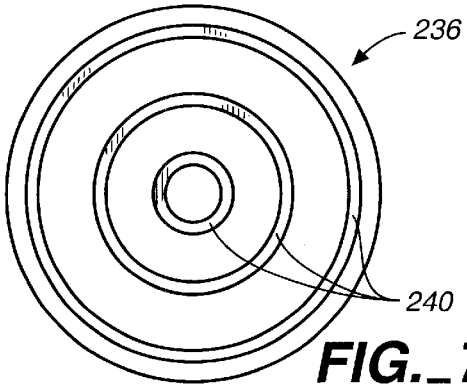

Referring now to FIGS. 6–8, there are shown further alternative embodiments of the fixtures (hereinafter designated with reference numerals 234, 236, respectively). The fixtures 234, 236 are each embodied as a number of thin-film spacers 240 which are positioned between the carrier body 38 and a wafer carrier film 242 (see FIG. 8). The spacers 240 are preferably constructed from mylar or acetate and may include an adhesive in order to affix the spacers 240 to the carrier body 38. Alternatively, the spacers 240 may be affixed to the carrier film 242 (which generally includes an adhesive) prior to installation of the carrier film 242 to the carrier body 38. In either case, the spacers 240 are interposed between the carrier film 242 and the carrier body 38. It should be appreciated that the carrier film 242 contacts the wafer 14 when the wafer 14 is handled by the wafer carrier assembly 26.

As shown, the spacers 240 are provided in predetermined locations and patterns in order to increase the downward polishing pressure being exerted on predetermined locations of the backside 32 of the semiconductor wafer 14. In such a manner, the locations in which pressure is increased on the backside 32 of the semiconductor wafer 14 may be specifically tailored to a given wafer design thereby allowing the polishing system 10 to remove non-uniformities which are unique to the given wafer design. Hence, a first group of spacers 240 (e.g. the fixture 234, collectively) which are adapted to apply polishing pressure to predetermined locations of a wafer of a first design type is secured to the carrier body 38 of the wafer carrier assembly 26 in order to polish wafers of the first design type. Thereafter, prior to polishing of semiconductor wafers of a second design type, the first fixture 234 (i.e. the first group of spacers 240) is removed, and a second group of spacers 240 (e.g. the fixture 236, collectively) which are adapted to apply polishing pressure to different predetermined locations of a wafer of a second design type are secured to the carrier body 38 of the wafer carrier assembly 26 in order to polish wafers of the second design type.

It should be appreciated that the spacers 240 may be constructed in varying thickness in order to selectively increase or decrease the polishing pressure exerted on the predetermined locations of the wafer 14. Moreover, it should be appreciated that the spacers 240 may be positioned in certain locations so as to create a desirable reduction in downward polishing pressure at certain locations of the wafer 14 which are not in operative contact with the spacers 240 (i.e. not positioned directly below one of the spacers 240). Hence, use of the spacers 240 allows for flexibility in that downward polishing pressure can be both increased and decreased at predetermined locations on the backside 32 of the wafer 14.

Figure 9:
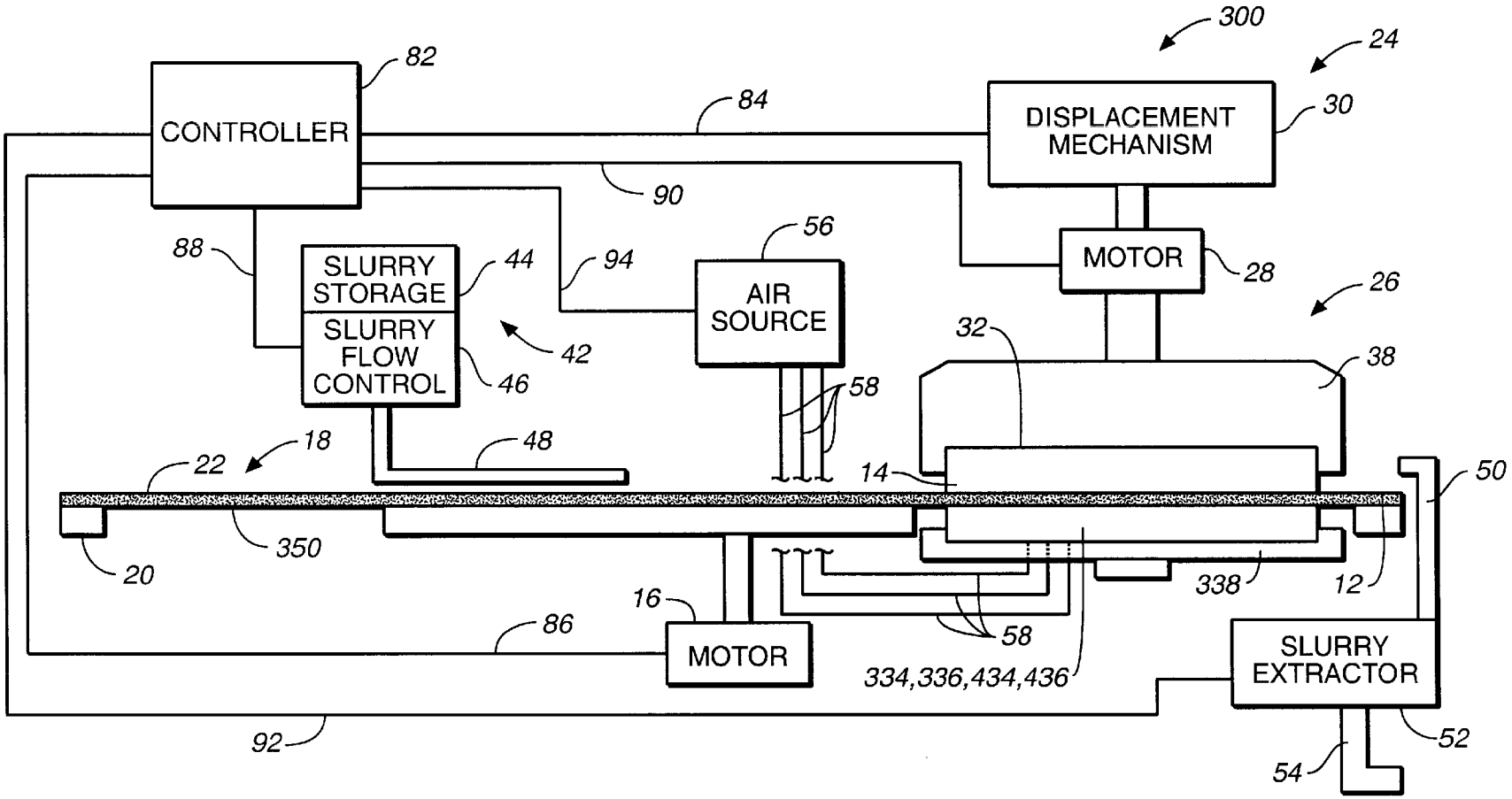
FIG. 9 is a side elevational view of another embodiment of a polishing system which incorporates the various features of the present invention therein.
Figure 10:
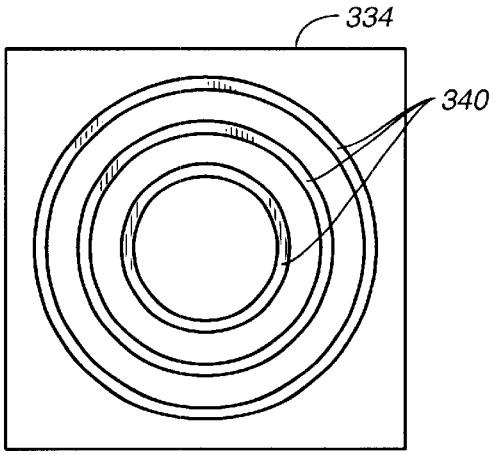
FIGS. 10–13 are plan views of fixtures which may be utilized to exert pressure on the polishing pad of the polishing system of FIG. 8.
Figure 11:
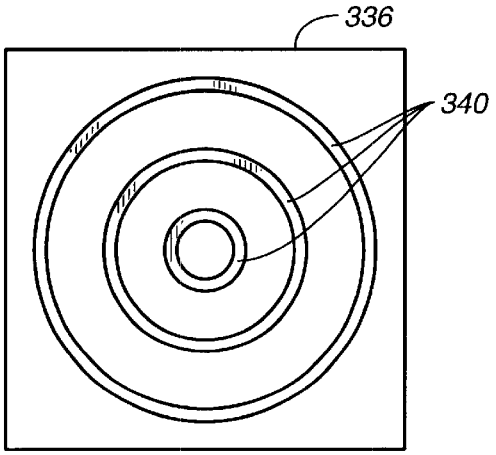

Referring now to FIGS. 9–11, there is shown an alternative embodiment of the polishing system 10 which is hereinafter referred to as a polishing system 300. The polishing system 300 is somewhat similar to the polishing system 10. Accordingly, the polishing system 300 includes a number of components which are identical to components previously discussed in regard to the polishing system 10. The same reference numerals are utilized in FIG. 9 to designate identical components which were previously discussed in regard to FIGS. 1–8 and additional discussion thereof is not warranted.

In lieu of utilizing various removable fixtures secured to the carrier body 38 of the wafer carrier assembly 26 to adjust downward polishing pressure on the wafer 14, the polishing system 300 includes removable fixtures which selectively adjust upward pressure on a backside 350 of the polishing pad 22 of the platen assembly 18. In particular, the polishing system 300 includes a fixture receptacle 338 which is located at a location below the platen assembly 18. A number of fixtures 334, 336 may be selectively secured to the fixture receptacle 338. Although any number of fixtures may be designed for use with the polishing system 300, for the sake of brevity, the following discussion will exemplary describe the use of two fixtures (i.e. the fixtures 334, 336). The fixtures 334, 336 may be selectively utilized in order to alter the polishing pressure exerted on predetermined locations of the front side 12 of the semiconductor wafer 14. In particular, each of the fixtures 334, 336 includes a number of air bladders 340 (see FIGS. 10 and 11) which are arranged in unique patterns on the fixture. The air bladders 340 may be selectively inflated or deflated in order to increase or decrease, respectively, pressure on the backside 350 of the polishing pad 22 of the platen assembly 18 thereby increasing or decreasing the upward polishing pressure being exerted at predetermined locations on the front side 12 of the semiconductor wafer 14. It should be appreciated that the material removal rate is increased at locations of the front side 12 of the wafer 14 where the polishing pressure is increased, whereas the material removal rate is decreased in locations of the front side 12 of the wafer 14 where the polishing pressure is decreased.

In such a manner, the locations at which pressure is increased or decreased on the front side 12 of the semiconductor wafer 14 may be specifically tailored to a given wafer design. In particular, as described above, it is known that fabrication of certain wafer designs creates surface non-uniformities which are unique to the given wafer design. Hence, a fixture (e.g. one of the fixtures 334, 336) may be designed which has its various air bladders 340 located in predetermined positions such that when inflated or deflated the upward polishing pressure is increased or decreased, respectively, in the corresponding locations of the wafer 14. Hence, a first fixture which is adapted to apply polishing pressure to predetermined locations of a wafer of a first design type (e.g. the fixture 334) may be secured to the fixture receptacle 338 in order to polish wafers of the first design type. Thereafter, prior to polishing of semiconductor wafers of a second design type, the first fixture 334 is removed, and a second fixture which is adapted to apply polishing pressure to predetermined locations of a wafer of a second design type (e.g. the fixture 336) is secured to the fixture receptacle 338 in order to polish wafers of the second design type.

It should be appreciated that the fixtures 334, 336 may be secured to the fixture receptacle 338 in a number of different manners. For example, fasteners such as bolts (not shown) may be utilized to secure the fixtures 334, 336 to the fixture receptacle 338. Moreover, "quick coupling" mechanisms may be utilized which allow the fixtures 334, 336 to be secured to, or removed from, the fixture receptacle 338 without the use of tools. In addition, it should be appreciated that the fixtures 334, 336 and the fixture receptacle 338 may each be configured with corresponding keying features in order to ensure proper installation alignment of the fixtures 334, 336 to the fixture receptacle 338.

As with the fixtures 34, 36 of the polishing system 10, the pressurized air source 56 is fluidly coupled to the air bladders 340 of the fixtures 334, 336 via the air lines 58. Each of the air lines 58 has a coupler (not shown) on an end thereof which mates with a corresponding coupler (not shown) on the fixtures 334, 336. In such a manner, the couplers can be quickly and easily coupled to one another when one of the fixtures 334, 336 is being secured to the fixture receptacle 338, but yet can also be quickly decoupled from one another when the fixtures 334, 336 are being removed from the fixture receptacle 338.

As with the polishing system 10, each of the air lines 58 is under independent control such that air pressure within each of the air lines 58 may be independently controlled in order to allow for selective inflation or deflation of the air bladders 340 of the fixtures 334, 336. Such independent control increases the flexibility of the polishing system 300 by allowing the locations at which pressure is exerted on the wafer 14 to be more precisely defined.

Figure 12:
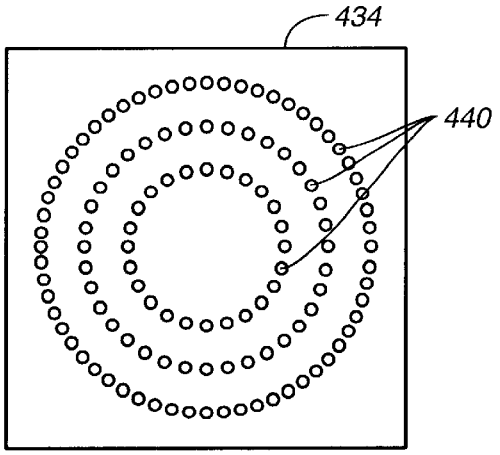
Figure 13:
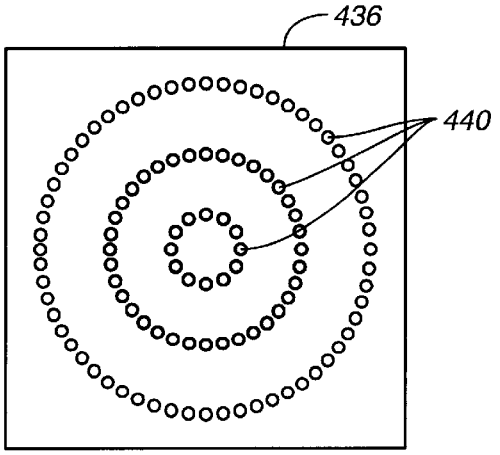

Referring now to FIGS. 12 and 13, there is shown alternative embodiments of the fixtures 334, 336 (hereinafter designated with reference numerals 434, 436, respectively). In lieu of the air bladders 340, the fixtures 434, 436 include a number of air orifices 440 which are positioned in predetermined locations and patterns on the fixtures. Pressurized air is selectively directed out of the air orifices 440 in order to increase the pressure being exerted on predetermined locations of the backside 350 of the polishing pad 22 so as to exert upward polishing pressure on the front side 12 of the semiconductor wafer 14. In such a manner, the locations at which pressure is increased on the front side 12 of the semiconductor wafer 14 may be specifically tailored to a given wafer design thereby allowing the polishing system 300 to remove non-uniformities which are unique to the given wafer design. Hence, a fixture (e.g. one of the fixtures 434, 436) may be designed which has its various air orifices 440 located at predetermined positions such that when pressurized air is advanced therethrough, upward polishing pressure in increased at the corresponding locations of the wafer 14. Hence, a first fixture which is adapted to apply polishing pressure to predetermined locations of a wafer of a first design type (e.g. the fixture 434) may be secured to the fixture receptacle 338 in order to polish wafers of the first design type. Thereafter, prior to polishing of semiconductor wafers of a second design type, the first fixture 434 is removed, and a second fixture which has air orifices 440 which are adapted to apply polishing pressure to different predetermined locations of a wafer (e.g. the fixture 436) is secured to the fixture receptacle 338 in order to polish wafers of the second design type.

As with the fixtures 334, 336, it should be appreciated that the fixtures 434, 436 may be secured to the fixture receptacle 338 in a number of different manners. For example, fasteners such as bolts (not shown) may be utilized to secure the fixtures 434, 436 to the fixture receptacle 338, or alternatively, "quick coupling" mechanisms may be utilized which allow the fixtures 434, 436 to be secured to, or removed from, the fixture receptacle 338 without the use of tools. In addition, it should be appreciated that the fixtures 434, 436 and the fixture receptacle 338 may each be configured with corresponding key features in order to ensure proper installation alignment of the fixtures 434, 436 to the fixture receptacle 338.

The pressurized air source 56 is fluidly coupled to the air orifices 440 via the air lines 58 in order to provide the pressurized air necessary for direction through the air orifices 440. Similarly to as described above in regard to the fixtures 334, 336, the couplers (not shown) associated with the air lines 58 and the fixtures 434, 436 can be quickly and easily coupled to one another when one of the fixtures 434, 436 is being secured to the fixture receptacle 338, but yet can also be quickly decoupled from one another when the fixtures 434, 436 are being removed from the fixture receptacle 338.

Since each of the air lines 58 is under independent control, air pressure within each of the air lines 58 may be independently altered in order to allow for selective increases in pressurized air being directed out of the air orifices 440. As with the fixtures 334, 336, such independent control of the pressurized air being advanced out of the air orifices 440 increases the flexibility of the polishing system 300 by allowing the locations in which pressure is exerted on the wafer 14 to be more precisely defined.

It should be appreciated that the polishing system 300 may be embodied with another type of polishing platen assembly 18 other than the round "table-type" assembly shown in FIGS. 1 and 9. In particular, the platen assembly 18 may be embodied with a "belt-type" polishing surface which is advanced around a pair of rollers. In such a configuration, the fixture receptacle 338 is positioned such that pressure is exerted on the underside of the upper portion of the belt by the air bladders 340 associated with the fixtures 334, 336 or the air orifices 440 associated with the fixtures 434,436.

Operation of the Present Invention

In operation, the polishing system 10 may be utilized to polish a number of different semiconductor wafer types in order to planarize the front side 12 thereof. In order to polish a first type of semiconductor wafer 14, the fixture 34 is installed or otherwise secured to the wafer body 38 of the wafer carrier assembly 32. Thereafter, wafers of the first wafer type are polished with the polishing system 10. In particular, the polishing system 10 removes material from the front side 12 of the semiconductor wafer 14 until the wafer 14 is polished down to a desired polishing endpoint layer. More specifically, the wafer carrier assembly 26 engages the backside 32 of the semiconductor wafer 14 and presses the front side 12 of the semiconductor wafer 14 against the polishing pad 22. The controller 82 then causes the platen motor 16 to rotate the platen assembly 18 and the wafer carrier motor 28 to rotate the wafer carrier assembly. The controller 82 may also begin to control the displacement mechanism 30 so as to move the wafer carrier assembly 26 along a predetermined polishing path. The slurry flow control mechanism 46 is also controlled by the controller 82 in order to apply chemical slurry to the polishing pad 22 at a predetermined flow rate. In addition, pressurized air is selectively advanced through the air lines 58 to selectively inflate and deflate the air bladders 40 associated with the fixture 34 thereby selectively increasing and decreasing the downward polishing pressure exerted on the wafer 14. The resulting complex movement of the wafer carrier assembly 26 relative to the polishing pad 22, the downward polishing force being applied to the semiconductor wafer 14, and the chemical slurry all cooperate to selectively remove material from the front side 12 of the semiconductor wafer 14.

Once all of the wafers 14 of the first wafer type have been polished, the fixture 34 is removed from the carrier body 38 such that the second fixture 36 may be secured to the carrier body 38. Thereafter, semiconductor wafers of the second wafer type may be polished in the manner described above. In particular, the controller 82 may be utilized to selectively increase and decrease pressure in the air lines 58 in order to selectively increase and decrease downward polishing pressure being exerted on the backside 32 of the wafer 14. Once all of the wafers of the second wafer type have been polished, another fixture may be secured to the carrier body 38 in order to polish yet another wafer type of semiconductor wafers 14.

The fixtures 134, 136 are utilized in a similar manner. In particular, the fixtures 134, 136 may be selectively secured and removed from the carrier body 38 in order to accommodate different wafer types since each of the fixtures 134, 136 includes a pattern of the air orifices 140 which corresponds to predetermined locations of the various wafer types. Likewise, the spacers 240 (see FIGS. 6 and 7) may also be added or removed from the carrier body 38 so as to accommodate various wafer types.

In regard to the polishing system 300, the polishing system 300 may be utilized to polish a number of different semiconductor wafer types in order to planarize the front side 12 thereof. In order to polish a first type of semiconductor wafer 14, the fixture 334 is installed or otherwise secured to the fixture receptacle 338. Thereafter, wafers of the first wafer type are polished with the polishing system 330. In particular, the polishing system 330 removes material from the front side 12 of the semiconductor wafer 14 until the wafer 14 is polished down to a desired polishing endpoint layer. More specifically, the wafer carrier assembly 26 engages the backside 32 of the semiconductor wafer 14 and presses the front side 12 of the semiconductor wafer 14 against the polishing pad 22. The controller 82 then causes the platen motor 16 to rotate the platen assembly 18 and the wafer carrier motor 28 to rotate the wafer carrier assembly 26. The controller 82 may also begin to control the displacement mechanism 30 so as to move the wafer carrier assembly 26 along a predetermined polishing path. The slurry flow control mechanism 46 is also controlled by the controller 82 in order to apply chemical slurry to the polishing pad 22 at a predetermined flow rate. In addition, pressurized air is selectively advanced through the air lines 58 to selectively inflate and deflate the air bladders 340 associated with the fixture 334 thereby selectively increasing and decreasing the upward pressure on the backside 350 of the polishing pad 22 and hence the upward polishing pressure exerted on the wafer 14. The resulting complex movement of the wafer carrier assembly 26 relative to the polishing pad 22, the downward polishing force being applied to the backside 32 of semiconductor wafer 14, the upward polishing pressure being applied to the front side 12 of the wafer, and the chemical polishing slurry all cooperate to selectively remove material from the front side 12 of the semiconductor wafer 14.

Once all of the wafers 14 of the first wafer type have been polished, the fixture 334 is removed from the fixture receptacle 338 such that the second fixture 336 may be secured to the fixture receptacle 338. Thereafter, semiconductor wafers 14 of the second wafer type may be polished in the manner described above. In particular, the controller 82 may be utilized to selectively increase and decrease pressure in the air lines 58 in order to selectively increase and decrease upward polishing pressure being exerted on the front side 12 of the wafer 14. Once all of the wafers 14 of the second wafer type have been polished, another fixture may be secured to the fixture receptacle 338 in order to polish yet another wafer type of semiconductor wafers 14.

The fixtures 434, 436 are utilized in a similar manner. In particular, the fixtures 434, 436 may be selectively secured and removed from the fixture receptacle 338 in order to accommodate different wafer types since each of the fixtures 434, 436 includes a pattern of the air orifices 440 which corresponds to predetermined locations of the various wafer types.

While the invention has been illustrated and described in detail in the drawings and foregoing description, such illustration and description is to be considered as exemplary and not restrictive in character, it being understood that only preferred embodiments have been shown and described and that all changes and modifications that come within the spirit of the invention are desired to be protected.

There are a plurality of advantages of the present invention arising from the various features of the polishing process described herein. It will be noted that alternative embodiments of the polishing process of the present invention may not include all of the features described yet still benefit from at least some of the advantages of such features. Those of ordinary skill in the art may readily devise their own implementations of the polishing process that incorporate one or more of the features of the present invention and fall within the spirit and scope of the present invention as defined by the appended claims.

What is claimed is:

1. A method of operating a chemical-mechanical polishing system having a wafer carrier assembly which includes a carrier body, said method comprising the steps of:

securing a first fixture to said carrier body, said first fixture being configured to apply pressure to a first semiconductor wafer at a first number of predetermined locations;

polishing said first semiconductor wafer while said first fixture is secured to carrier body;

removing said first fixture from said carrier body;

securing a second fixture to said carrier body, said second fixture being configured to apply pressure to a second semiconductor wafer at a second number of predetermined locations which are different than said first number of predetermined locations of said first wafer; and polishing said second semiconductor wafer while said second fixture is secured to said carrier body.

2. The method of claim 1, wherein:

said first fixture includes a first number of air bladders, said first number of air bladders being configured to apply pressure to said first semiconductor wafer at said first number of predetermined locations, said step of polishing said first semiconductor wafer includes the step of polishing said first semiconductor wafer while said first fixture is secured to said carrier body such that said first number of air bladders contact a backside of said first semiconductor wafer at said first number of predetermined locations so as to urge a front side of said first semiconductor wafer into contact with a polishing pad, said second fixture includes a second number of air bladders, said second number of air bladders being configured to apply pressure to said second semiconductor wafer at said second number of predetermined locations, and said step of polishing said second semiconductor wafer includes the step of polishing said second semiconductor wafer while said second fixture is secured to said carrier body such that said second number of air bladders contact a backside of said second semiconductor wafer at said second number of predetermined locations so as to urge a front side of said second semiconductor wafer into contact with a polishing pad.

3. The method of claim 2, wherein:

said polishing system includes an air pressure source, said step of securing said first fixture to said carrier body includes the step of coupling said first number of air bladders to said air pressure source, said step of removing said first fixture from said carrier body includes the step of de-coupling said first number of air bladders from said air pressure source, and said step of securing said second fixture to said carrier body includes the step of coupling said second number of air bladders to said air pressure source.

4. The method of claim 1, wherein:

said first fixture includes a first number of air orifices, said first number of air orifices being configured to direct pressurized air therefrom, said step of polishing said first semiconductor wafer includes the step of polishing said first semiconductor wafer while said first fixture is secured to said carrier body such that said first number of air orifices direct pressurized air onto a backside of said first semiconductor wafer at said first number of predetermined locations so as to urge a front side of said first semiconductor wafer into contact with a polishing pad, said second fixture includes a second number of air orifices, said second number of air orifices being configured to direct pressurized air therefrom, and said step of polishing said second semiconductor wafer includes the step of polishing said second semiconductor wafer while said second fixture is secured to said carrier body such that said second number of air orifices direct pressurized air onto a backside of said second semiconductor wafer at said second number of predetermined locations so as to urge a front side of said second semiconductor wafer into contact with a polishing pad.

5. The method of claim 4, wherein:

said polishing system includes an air pressure source, said step of securing said first fixture to said carrier body includes the step of coupling said first number of air orifices to said air pressure source, said step of removing said first fixture from said carrier body includes the step of de-coupling said first number of air orifices from said air pressure source, and said step of securing said second fixture to said carrier body includes the step of coupling said second number of air orifices to said air pressure source.

6. The method of claim 1, wherein:

said first fixture includes a first number of spacers, said first number of spacers being configured to apply pressure to said first semiconductor wafer at said first number of predetermined locations, said step of polishing said first semiconductor wafer includes the step of polishing said first semiconductor wafer while said first fixture is secured to said carrier body such that said first number of spacers are positioned in operative contact with a backside of said first semiconductor wafer at said first number of predetermined locations so as to urge a front side of said first semiconductor wafer into contact with a polishing pad, said second fixture includes a second number of spacers, said second number of spacers being configured to apply pressure to said second semiconductor wafer at said second number of predetermined locations, and said step of polishing said second semiconductor wafer includes the step of polishing said second semiconductor wafer while said second fixture is secured to said carrier body such that said second number of spacers are positioned in operative contact with a backside of said second semiconductor wafer at said second number of predetermined locations so as to urge a front side of said second semiconductor wafer into contact with a polishing pad.

7. The method of claim 6, wherein:

said wafer carrier assembly includes a wafer carrier film, said step of securing said first fixture to said carrier body includes the step of positioning said first number of spacers between said carrier body and said wafer carrier film, said wafer carrier film contacts said backside of said first semiconductor wafer during said step of polishing said first semiconductor wafer, said step of securing said second fixture to said carrier body includes the step of positioning said second number of spacers between said carrier body and said wafer carrier film, and said wafer carrier film contacts said backside of said second semiconductor wafer during said step of polishing said second semiconductor wafer.

8. A chemical-mechanical polishing apparatus for polishing a first side of a semiconductor wafer, comprising:

a polishing platen having a polishing surface; and a wafer carrier assembly having a carrier body, said wafer carrier assembly being adapted to (i) engage said wafer by a second side of said wafer, and (ii) apply pressure to said wafer in order to press said wafer against said polishing surface of said polishing platen, wherein (i) said wafer carrier assembly is operable in a first carrier configuration and a second carrier configuration, (ii) a first fixture which is configured to apply pressure to said wafer at a first number of predetermined locations is secured to said carrier body when said wafer carrier assembly is operated in said first carrier configuration, and (ii) a second fixture which is configured to apply pressure to said wafer at a second number of predetermined locations which are different than said first number of predetermined locations is secured to said carrier body when said wafer carrier assembly is operated in said second carrier configuration.

9. The apparatus of claim 8, wherein:

said first fixture includes a first number of air bladders, said first number of air bladders being configured to apply pressure to said wafer at said first number of predetermined locations when said wafer carrier assembly is operated in said first carrier configuration, and said second fixture includes a second number of air bladders, said second number of air bladders being configured to apply pressure to said wafer at said second number of predetermined locations when said wafer carrier assembly is operated in said second carrier configuration.

10. The apparatus of claim 9, further comprising an air pressure source, wherein:

said first number of air bladders of said first fixture are coupled to said air pressure source when said first fixture is secured to said carrier body, and said second number of air bladders of said second fixture are coupled to said air pressure source when said second fixture is secured to said carrier body.

11. The apparatus of claim 8, wherein:

said first fixture includes a first number of air orifices, said first number of air orifices being configured to direct pressurized air onto said wafer at said first number of predetermined locations when said wafer carrier assembly is operated in said first carrier configuration, and said second fixture includes a second number of air orifices, said second number of air orifices being configured to direct pressurized air onto said wafer at said second number of predetermined locations when said wafer carrier assembly is operated in said second carrier configuration.

12. The apparatus of claim 11, further comprising an air pressure source, wherein:

said first number of air orifices of said first fixture are coupled to said air pressure source when said first fixture is secured to said carrier body, and said second number of air orifices of said second fixture are coupled to said air pressure source when said second fixture is secured to said carrier body.

13. The apparatus of claim 8, wherein:

said first fixture includes a first number of spacers, said first number of spacers being configured to apply pressure to said wafer at said first number of predetermined locations when said wafer carrier assembly is operated in said first carrier configuration, and said second fixture includes a second number of spacers, said second number of spacers being configured to apply pressure to said wafer at said second number of predetermined locations when said wafer carrier assembly is operated in said second carrier configuration.

14. The apparatus of claim 13, further comprising a wafer carrier film, wherein:

said first number of spacers are interposed between said carrier body and said wafer carrier film when said wafer carrier assembly is operated in said first carrier configuration, said second number of spacers are interposed between said carrier body and said wafer carrier film when said wafer carrier assembly is operated in said second carrier configuration, and said wafer carrier film contacts said wafer during polishing of said wafer.

15. A method of operating a chemical-mechanical polishing system which has a polishing surface associated therewith, said method comprising the steps of:

securing a first fixture to a fixture receptacle which is located proximate to said polishing surface, said first fixture being configured to apply pressure to said polishing surface at a first number of predetermined locations;

polishing a first semiconductor wafer while said first fixture is secured to said fixture receptacle;

removing said first fixture from said fixture receptacle;

securing a second fixture to said fixture receptacle, said second fixture being configured to apply pressure to said polishing surface at a second number of predetermined locations which are different than said first number of predetermined locations; and polishing a second semiconductor wafer while said second fixture is secured to said fixture receptacle.

16. The method of claim 15, wherein:

said first fixture includes a first number of air bladders, said first number of air bladders being configured to apply pressure to said polishing surface at said first number of predetermined locations, said step of polishing said first semiconductor wafer includes the step of polishing said first semiconductor wafer while said first fixture is secured to said fixture receptacle such that said first number of air bladders contact said polishing surface at said first number of predetermined locations, said second fixture includes a second number of air bladders, said second number of air bladders being configured to apply pressure to said polishing surface at said second number of predetermined locations, and said step of polishing said second semiconductor wafer includes the step of polishing said second semiconductor wafer while said second fixture is secured to said fixture receptacle such that said second number of air bladders contact said polishing surface at said second number of predetermined locations.

17. The method of claim 16, wherein:

said polishing system includes an air pressure source, said step of securing said first fixture to said fixture receptacle includes the step of coupling said first number of air bladders to said air pressure source, said step of removing said first fixture from said fixture receptacle includes the step of de-coupling said first number of air bladders from said air pressure source, and said step of securing said second fixture to said fixture receptacle includes the step of coupling said second number of air bladders to said air pressure source.

18. The method of claim 15, wherein:

said first fixture includes a first number of air orifices, said first number of air orifices being configured to direct pressurized air therefrom, said step of polishing said first semiconductor wafer includes the step of polishing said first semiconductor wafer while said first fixture is secured to said fixture receptacle such that said first number of air orifices direct pressurized air onto said polishing surface at said first number of predetermined locations, said second fixture includes a second number of air orifices, said second number of air orifices being configured to direct pressurized air therefrom, and said step of polishing said second semiconductor wafer includes the step of polishing said second semiconductor wafer while said second fixture is secured to said fixture receptacle such that said second number of air orifices direct pressurized air onto said polishing surface at said second number of predetermined locations.

19. The method of claim 18, wherein:

said polishing system includes an air pressure source, said step of securing said first fixture to said fixture receptacle includes the step of coupling said first number of air orifices to said air pressure source, said step of removing said first fixture from said fixture receptacle includes the step of de-coupling said first number of air orifices from said air pressure source, and said step of securing said second fixture to said fixture receptacle includes the step of coupling said second number of air orifices to said air pressure source.

* * * * *